US008192511B2

(12) United States Patent
Wei

(10) Patent No.: US 8,192,511 B2
(45) Date of Patent: Jun. 5, 2012

(54) METHODS AND COMPOSITIONS FOR DECREASING CARBON EMISSIONS

(76) Inventor: Pichang Wei, Changchun (CN)

( * ) Notice: Subject to any disclaimer, the term of this patent is extended or adjusted under 35 U.S.C. 154(b) by 402 days.

(21) Appl. No.: 12/494,351

(22) Filed: Jun. 30, 2009

(65) Prior Publication Data

US 2009/0320728 A1 Dec. 31, 2009

(30) Foreign Application Priority Data

Jun. 30, 2008 (CN) ..... 2008 1 0131415

(51) Int. Cl.
*C10L 1/12* (2006.01)

(52) U.S. Cl. ..... 44/457; 44/324; 44/385; 44/413; 44/417; 44/418; 44/445; 44/458

(58) Field of Classification Search ..... 44/457, 44/324, 385, 413, 417, 418, 445, 458
See application file for complete search history.

(56) References Cited

U.S. PATENT DOCUMENTS

| | | | | |
|---|---|---|---|---|
| 3,178,325 | A * | 4/1965 | Scott, Jr. | 149/67 |
| 3,886,872 | A * | 6/1975 | Mallen | 110/342 |
| 2010/0242350 | A1* | 9/2010 | Tock et al. | 44/457 |

FOREIGN PATENT DOCUMENTS

CN 101306967 A 11/2008

OTHER PUBLICATIONS

Wang Xuguang et al., Theory and Practice of Slurry Explosives, Book, May 1985, pp. 79-80, table 2-35, Metallurgical Industry Press, China.

Wang Qilai et al., Ammonium Nitrate Explosives, Book, Feb. 1984, pp. 212-213, No. 1212359, National Defence Industry Press, China.

GEA Process Engineering China Ltd., Treating and Filling of Powders, http://www.geape-asia.com/gtesh/cmsdoc.nsf/WebDoc/ndkw73wd5l.

Wang Xuguang et al., Theory and Practice of Slurry Explosives, Book, May 1985, pp. 28-29, Metallurgical Industry Press, China.

Wang Xuguang et al., Theory and Practice of Slurry Explosives, Book, May 1985, pp. 274-275, Metallurgical Industry Press, China.

SIPO, The First Examination Report for CN Appl. No. 200810131415.7, Jan. 10, 2011, pp. 1-4, SIPO Examination Department, Beijing, China.

* cited by examiner

*Primary Examiner* — Cephia D Toomer
(74) *Attorney, Agent, or Firm* — Matthias Scholl P.C.; Matthias Scholl

(57) ABSTRACT

A method of burning fuel in a combustion chamber whereby reducing overall carbon emissions, comprising: feeding an oxidizing component and a combustible component to a combustion chamber in a ratio based on zero oxygen balance principle, wherein the oxidizing component has an oxygen balance value of more than zero, and the combustible component has an oxygen balance value of less than zero. The method of burning fuel can reduce overall carbon emissions, even to zero.

17 Claims, 4 Drawing Sheets

METHODS AND COMPOSITIONS FOR DECREASING CARBON EMISSIONS

CROSS-REFERENCE TO RELATED APPLICATIONS

Pursuant to 35 U.S.C. §119 and the Paris Convention Treaty, this application claims the benefit of Chinese Patent Application No. 200810131415.7 filed Jun. 30, 2008, the contents of which are incorporated herein by reference.

BACKGROUND OF THE INVENTION

1. Field of the Invention

The invention relates to compositions and methods for decreasing overall carbon emissions.

2. Description of the Related Art

Black powder is the oldest oxidant-containing high energy fuel. From its birth, powder has always been an important energy source for military and civil use. Black powder comprises an oxidizing component (oxidant) and a combustible component (combustible agent). When an oxidation-reduction reaction occurs between the two components, a large amount of energy is released and promotes the operation of, e.g., aircrafts, such as rockets, missiles, and airplanes.

Similarly, the burning of gasoline, kerosene, or diesel is an oxidation-reduction reaction between an oxidizing component (oxygen in air) and a combustible component (hydrocarbons in gasoline, kerosene, or diesel). Besides gasoline, kerosene, and diesel, conventional fuels further include liquefied petroleum gas (LPG), compressed natural gas (CNG), liquefied natural gas (LNG), ethanol, methanol, dimethyl ether (DME), bio-diesel, and oil made from coal.

The burning of the fuels is an oxidation-reduction reaction; however, usually, the reaction does not take place in conformity with the principle of zero oxygen balance. Take gasoline as an example. The general formula of hydrocarbons gasoline is $C_nH_{2n+2}$, some $C_nH_{2n}$, and perhaps a small number of impurities containing elements such as S, N, and P. Under the condition of zero oxygen balance, reaction products should only be $CO_2$, $H_2O$, $N_2$, and oxides containing S, P, or a mixture thereof. However, studies have shown that automobile exhaust have 150-200 types of compounds, comprising carbon monoxide, hydrocarbons, nitrogen oxide, lead compounds, and particulate matter, all of which are signs of incomplete combustion and impurity of fuel.

Currently, not much attention is being paid to the principle of zero oxygen balance in an oxidation-reduction reaction between an oxidizing component and a combustible component. Due to environmental concerns, it is urgent to develop methods of reducing carbon emissions of fuels.

SUMMARY OF THE INVENTION

In view of the above-described problems, it is one objective of the invention to provide a method of burning fuel, whereby decreasing overall carbon emissions by 94% or more, and even to zero.

To achieve the above objectives, in accordance with one embodiment of the invention, there is provided a method of burning fuel, whereby decreasing overall carbon emissions by 94% or more, and even to zero, comprising feeding an oxidizing component and a combustible component to a combustion chamber, in amounts based on zero oxygen balance principle, wherein an oxygen balance value of the oxidizing component is more than zero, and an oxygen balance value of the combustible component is less than zero.

In a class of this embodiment, the oxidizing component is hydrogen peroxide, ammonium nitrate aqueous solution, or powdery ammonium nitrate, potassium nitrate, sodium nitrate, calcium nitrate, hydrazine nitrate, ammonium perchlorate, sodium perchlorate, potassium perchlorate, potassium chlorate, potassium dichromate, or sodium nitrite.

In a class of this embodiment, a concentration of the ammonium nitrate aqueous solution is 84-91% by weight at 80-100° C.

In a class of this embodiment, the combustible component is liquid polyacrylamide, glycol, diethylene glycol dinitrate, nitromethane, gasoline, light diesel oil, mineral oil, or powdery amine methyl nitrate, calcium stearate, polyacrylamide, dextrin, starch, charcoal, sugar, dodecylbenzene sodium nitrate, trimethylamine nitrate, cellulose, wood powder, urea, urea nitrate, trinitronaphthalene, sodium dinitrotoluene sulfonate, dinitrotoluene, or amine methyl nitrate aqueous solution, or aluminum powder, zinc powder, silica powder, or hydrogen.

In a class of this embodiment, the concentration of the amine methyl nitrate aqueous solution is 80-90% by weight at 80-100° C.

In a class of this embodiment, the mesh number of the powdery oxidizing component is between 30 and 10,000, and the particle diameter is preferably between 1.3 μm and 550 μm.

In a class of this embodiment, the mesh number of the powdery combustible component is between 30 and 10,000, and the particle diameter is preferably between 1.3 μm and 550 μm.

When the oxidizing component or the combustible component is prepared as a powder, the smaller the size of the powder particles, the more complete the reaction, and the more energy is extracted.

In embodiments of the invention, the term "zero oxygen balance principle" means that an absolute value of the weight of an oxidizing component multiplied by the positive oxygen balance value thereof is equivalent to that of the weight of a combustible component multiplied by the negative oxygen balance value thereof. As a result of an oxidation-reduction reaction between a fuel and an oxidant provided in a ratio according to a "zero oxygen balance principle", carbon is completely oxidized into carbon dioxide, hydrogen completely oxidized into water, nitrogen impurities reduced into nitrogen gas, and metals or nonmetals oxidized into oxides thereof. There is no oxygen excess or insufficiency (Theory and Practice of Slurry Explosive, Wang Xuguang, et al., Metallurgical Industry Press (The 1st version), May, 1985, 79-80).

The fuel comprises an oxidizing component and a combustible component. The oxidizing component guarantees that, even in absence of ambient oxygen, burning can occur, resulting in release of heat and gases and doing work. The fuel has capability of self supplying oxygen. The self supply of oxygen means an oxidation-reduction reaction can occur without external supply of oxygen.

Due to self supply of oxygen of fuel in embodiments of the invention, for a conventional turbofan jet engine, a compressor and an internal air channel can be saved, so a technology difficulty of air distribution is overcome, and the weight of conventional turbofan jet engines is reduced.

As shown in FIG. 1, a conventional turbofan jet engine comprises an inlet 1, a compressor 2, a combustion chamber 3, a turbine 4, a nozzle 5, a fan 6, an external air channel 7, and an internal air channel 8.

As shown in FIG. 2, a turbofan jet engine of burning a low carbon content of fuel of the invention comprises an inlet 1, a combustion chamber 3, a turbine 4, a nozzle 5, a fan 6, and an external air channel 7. Therefore, compared with that in FIG. 1, the compressor 2 and the internal air channel 8 are not needed.

Due to the capability of self supply of oxygen of fuel and no need of external supply of oxygen, in this invention, the compressor 2 and the internal air channel 8 are eliminated. In FIG. 1, a front opening of the internal air channel 8 is closed, and the compressor 2 is removed. In FIG. 2, the turbine 4 is closer to the fan 6, and therefore the total length of the combustion chamber is shortened, the total weight of the engine is reduced.

The design and manufacturing of engines for low carbon content of fuels and fuel transmitting system are covered by prior art.

Materials for preparation of low carbon content of fuels is optionally selected from green plants, coal, air, and water, such as ammonium nitrate, cellulose, charcoal, wood powder, and starch. They are ground and selected according to particle diameters, prepared as powders or solution, and stored separately. Methods for grinding, selection, and storage all are disclosed by prior art.

According the principle of zero oxygen balance, the weight percent of the oxidizing component A is:

$$A\%=[K_b/(K_a+K_b)]\times 100\%;$$

the weight percent of the oxidizing component B is:

$$B\%=[K_a/(K_a+K_b)]\times 100\%;$$

wherein $K_a$ is the oxygen balance value of the oxidizing component A, and $K_b$ is the oxygen balance value of the combustible component B (Ammonium nitrate explosives, Wang Qilai, National Defense Industry Press, February 1984, 212-213).

For example, for ammonium nitrate, an oxidizing component A, the oxygen balance value $K_a$ is +0.20; for light diesel oil, a combustible component B, the oxygen balance value $K_b$ is −3.420. According to the above formulas, the weight percent of the two components is: A%=94.48%, B%=5.52%.

The consumption of light diesel oil is reduced by more than 94%, and carbon emissions are reduced by more than 94% accordingly. In order to transmit smoothly, ammonium nitrate can be made as an aqueous solution.

Table 1 lists oxygen balance value of some oxidizing components. Table 2 lists oxygen balance value of some combustible components. Based on Tables 1 and 2, the weight percent of a random combination of an oxidizing component and a combustible component can be calculated.

TABLE 1

Oxygen balance value of oxidizing component

| Oxidizing component | Oxygen balance value | Oxidizing component | Oxygen balance value |
|---|---|---|---|
| Ammonium nitrate | +0.2 | Sodium perchlorate | +0.523 |
| Potassium nitrate | +0.396 | Potassium perchlorate | +0.462 |
| Sodium nitrate | +0.471 | Potassium chlorate | +0.392 |
| Calcium nitrate | +0.488 | Potassium dichromate | +0.1263 |
| Hydrazine nitrate | +0.084 | Sodium nitrite | +0.348 |
| Ammonium perchlorate | +0.34 | Hydrogen peroxide | +0.470 |

TABLE 2

Oxygen balance value of combustible component

| Combustible component | Oxygen balance value | Combustible component | Oxygen balance value |
|---|---|---|---|
| Amine methyl nitrate | −0.340 | Polyacrylamide | −1.69 |
| Calcium stearate | −2.740 | Glycol | −1.29 |
| Polyacrylamide | −1.69 | Diethylene glycol dinitrate | −0.408 |
| Dextrin | −1.185 | Nitromethane | −0.395 |
| Starch | −1.185 | Gasoline | −3.460 |
| Charcoal | −2.667 | Light diesel oil | −3.420 |
| Dodecylbenzene sodium nitrate | −2.30 | Mineral oil | −3.460 |
| Trimethylamine nitrate | −1.048 | Aluminum powder | −0.89 |
| Cellulose | −1.185 | Trinitronaphthalene | −1.393 |
| Wood powder | −1.370 | Urea | −0.80 |
| Sodium Dinitrotoluene sulfonate | −0.680 | Dinitrotoluene | −1.142 |
| Hydrogen | −8.0 | | |

The storage and transmission of the oxidizing component, the combustible component, and solution thereof are covered by prior art. The methods disclosed by GEA Engineering Technology (China) Co., Ltd. can be taken as reference.

The application of conventional fuels is covered by the fuels of the invention.

Advantages of the invention are summarized below:

1) Environmentally friendly: the oxidizing component and combustible component of the invention is composed of elements selected from carbon, hydrogen, oxygen, nitrogen, metals, and non-metals, under the condition of zero oxygen balance, reaction products are a small amount of $CO_2$, $N_2$, $H_2O$, metallic and non-metallic oxides.
2) Safe: it is well-known that fuel oil is highly volatile, and a mixture of gasoline and air is likely to explode in an open fire. The oxidizing component and combustible component of fuel of the invention are separately stored, so it is much safer.
3) Cost-effective: the price of ammonium nitrate, an oxidizing component of the fuel, is 25% lower than that of fuel oil, while the low carbon content of fuel has a high volume energy density.
4) Self-supply of oxygen: the low carbon content of fuel has capability of self-supplying of oxygen, which improves submerging time of a submarine, save a compressor of a vehicle working in plateaus. Due to self-supply of oxygen, under low atmospheric pressure, vehicles and tanks do not need to reduce the power.
5) Advantages of the low carbon content of fuel over conventional fuels is shown from Table 3 (Forecast of Vehicle Ownership in China by Income Distribution Curve, Shen Zhongyuan, International Petroleum Economics, Apr. 30, 2007):

TABLE 3

Evaluation standards for automobile fuel

| Index | Content |
|---|---|
| Automobile performance | Distance range after refueling or recharging, output power, etc. |
| Economy parameter | Car prices, fuel prices, fuel supply infrastructure |

TABLE 3-continued

| Evaluation standards for automobile fuel | |
|---|---|
| Index | Content |
| The performance of atmospheric environment | Emissions |
| Comprehensive efficiency | WTW energy efficiency, $CO_2$ emissions |
| The supply of energy | Abundance of resource, diversity, and safety of fuels (Toxicity, Flammability) |
| Remarks | WTW: Well To Wheel, i.e., from exploitation to consumption of energy |

BRIEF DESCRIPTION OF THE DRAWINGS

The invention is described hereinbelow with reference to accompanying drawings, in which.

DETAILED DESCRIPTION OF THE EMBODIMENTS

Figure 1:
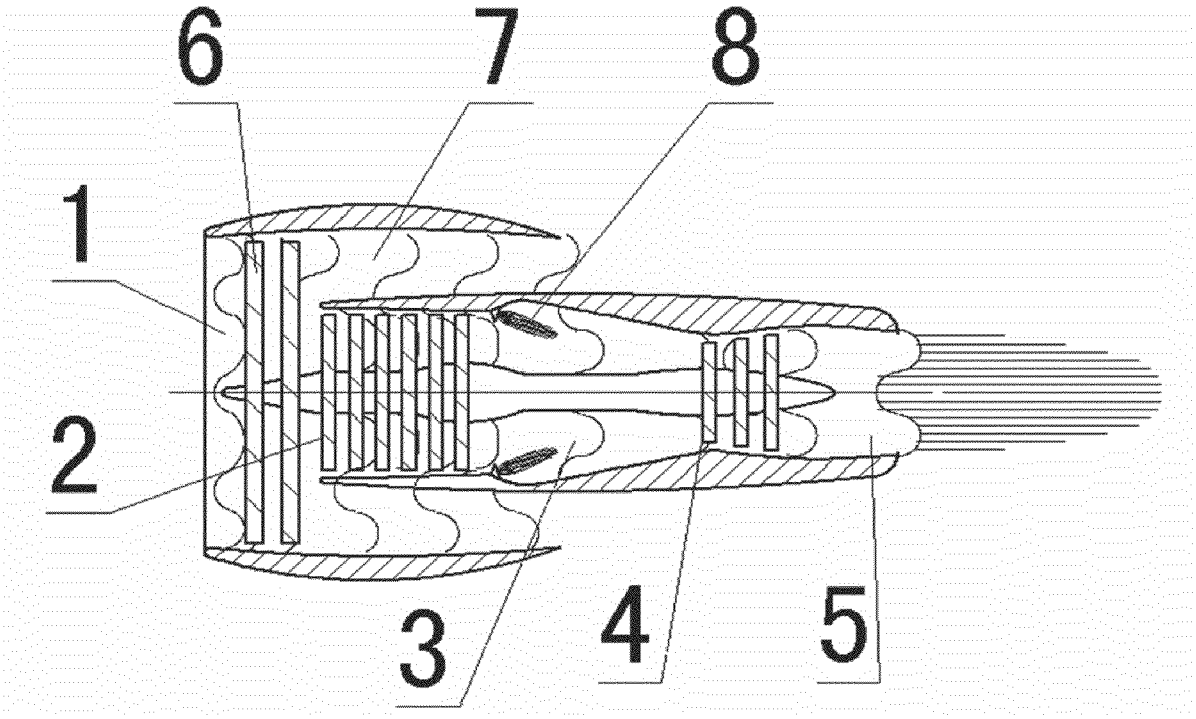
(PRIOR ART) FIG. 1
FIG. 1 is a schematic diagram of a conventional turbofan jet engine.
Figure 2:
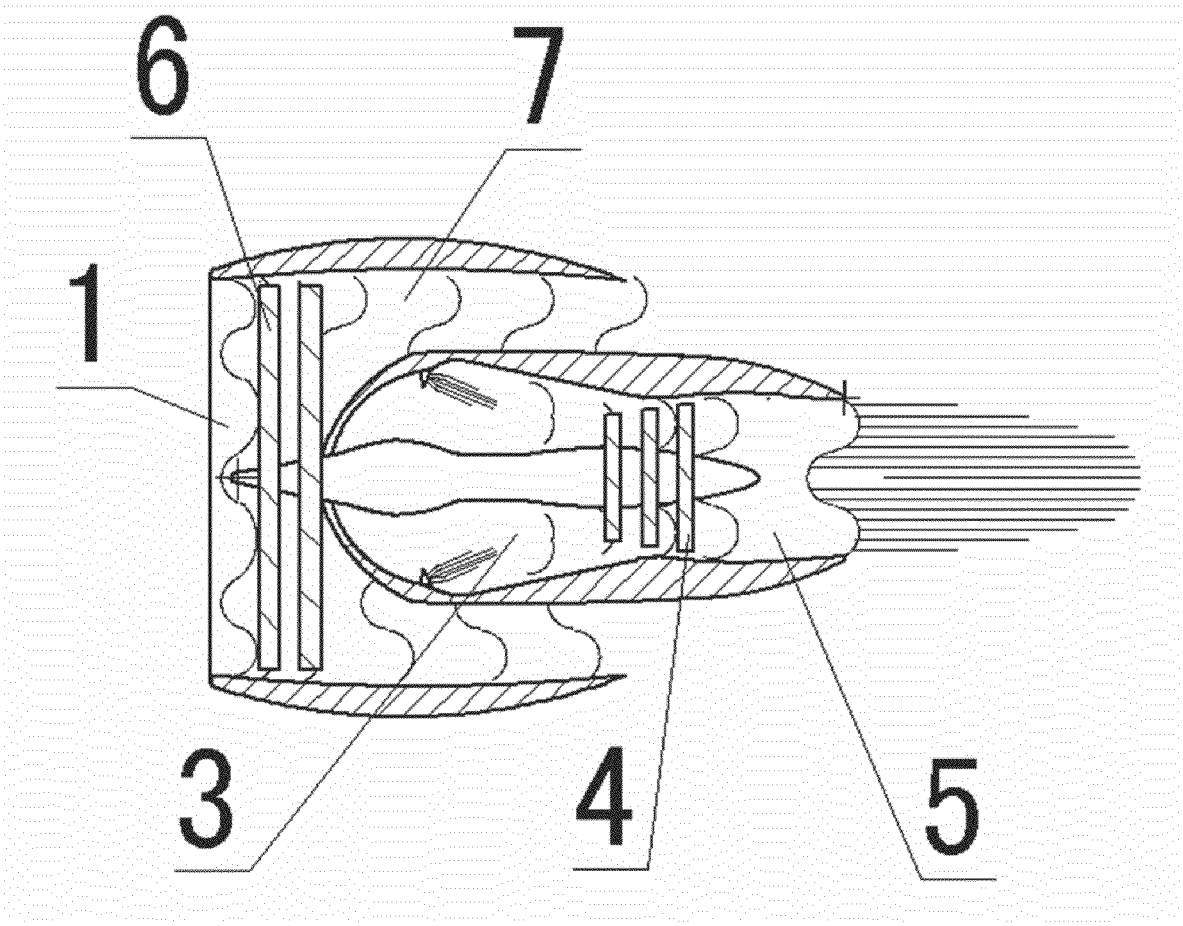
FIG. 2 is a schematic diagram of a turbofan jet engine according to one embodiment of the invention.

It is well-known that ammonium nitrate is easily dissolved in water. In embodiments of the invention, ammonium nitrate exists in form of an aqueous solution so that its hygroscopicity and caking capacity are overcome, and the transportation and safety factor are enhanced. For example, between 80° C. and 100° C., 84-91% by weight of ammonium nitrate solution is prepared. When the temperature is not lower than 80-100° C., the ammonium nitrate solution will not crystallize.

For further illustrating the invention, experiments detailing the preparation of fuel for use in embodiments of the invention are described below. Examples 1-5 describe fuels with which low carbon emissions are achieved. Examples 6-7 describe fuels with which no carbon emissions can be achieved. Examples 8-12 illustrate a method of burning fuel. It should be noted that the following examples are intended to describe and not to limit the invention.

EXAMPLE 1

Powder and Liquid

As a combustible component amine methyl nitrate powder and as an oxidizing component hydrogen peroxide were separately prepared, the weight ratio being:

| Components | $CH_3—NH_2•HNO_3$ | $H_2O_2$ |
|---|---|---|
| Oxygen balance value | −0.340 | +0.470 |
| Weight ratio (%) | 58.0247 | 41.9753 |

EXAMPLE 2

Powder and Powder

As a combustible component urea powder and as an oxidizing component ammonium nitrate were separately prepared, the weight ratio being:

| Components | $CO(NH_2)_2$ | $NH_4NO_3$ |
|---|---|---|
| Oxygen balance value | −0.800 | +0.20 |
| Weight ratio (%) | 20 | 80 |

EXAMPLE 3

Liquid and Solution

As a combustible component liquid nitromethane and as an oxidizing component ammonium nitrate aqueous solution were separately prepared, the weight ratio being:

| Components | $CH_3NO_3$ | $NH_4NO_3$ |
|---|---|---|
| Oxygen balance value | −0.395 | +0.2 |
| Weight ratio (%) | 33.613 | 66.387 |

The ammonium nitrate aqueous solution was prepared at 80-100° C., with a concentration of 84-93% by weight. The temperature should be maintained to prevent ammonium nitrate from crystallizing.

EXAMPLE 4

Fuel Oil and Powder

As a combustible component light diesel and as an oxidizing component ammonium nitrate powder were separately prepared, the weight ratio being:

| Components | $C_{16}H_{32}$ | $NH_4NO_3$ |
|---|---|---|
| Oxygen balance value | −3.420 | +0.2 |
| Weight ratio (%) | 5.5249 | 94.4751 |

In this example, under the condition of zero oxygen balance, the weight ratio of light diesel is less than 6%. Compared with a conventional method where the weight ratio of light diesel is 100%, the example reduces carbon emissions by more than 94%.

In this example, as a combustible component light diesel can be optionally substituted with gasoline, diesel, kerosene, or heavy oil. Although light diesel has high carbon content, the absolute value of oxygen balance value thereof is also large, so the weight ratio of light diesel is low, and therefore the carbon emissions are low.

EXAMPLE 5

Solution and Solution

As a combustible component 86% by weight of amine methyl nitrate aqueous solution and as an oxidizing component 84-93% by weight of ammonium nitrate aqueous solution were separately prepared, the weight ratio being:

| Components | $CH_3—NH_2•HNO_3$ | $NH_4NO_3$ |
|---|---|---|
| Oxygen balance value | −0.34 | +0.2 |
| Weight ratio (%) | 37.0370 | 62.9630 |

EXAMPLE 6

Metal Powder and Another Powder

As a combustible component aluminum powder and as an oxidizing component ammonium nitrate powder were separately prepared, the weight ratio being:

| Components | Al | $NH_4NO_3$ |
|---|---|---|
| Oxygen balance value | −0.89 | +0.2 |
| Weight ratio (%) | 18.349 | 81.651 |

In the example, the components have no carbon element, so the prepared fuel has no carbon emissions, i.e. zero carbon emissions. The resultant metal oxide is acidic.

EXAMPLE 7

Gas and Powder

As a combustible component hydrogen and as an oxidizing component ammonium nitrate powder were separately prepared, the weight ratio being:

| Components | $H_2$ | $NH_4NO_3$ |
|---|---|---|
| Oxygen balance value | −8.0 | +0.20 |
| Weight ratio (%) | 2.439 | 97.561 |

In this example, a small amount of hydrogen was consumed. Hydrogen was prepared from water and was oxidized into water. So the invention is environmentally friendly, sustainable, and renewable.

It should be noted that, all the solutions in the above examples were prepared from anhydrous compounds.

EXAMPLE 8

According to Example 2, as a combustible component urea powder and as an oxidizing component ammonium nitrate powder were prepared, and the particle size of the powders is 30-10000 mesh, and the weight ratio is given below:

| Components | $CO(NH_2)_2$ | $NH_4NO_3$ |
|---|---|---|
| Oxygen balance value | −0.800 | +0.20 |
| Weight ratio (%) | 20 | 80 |

Figure 3:
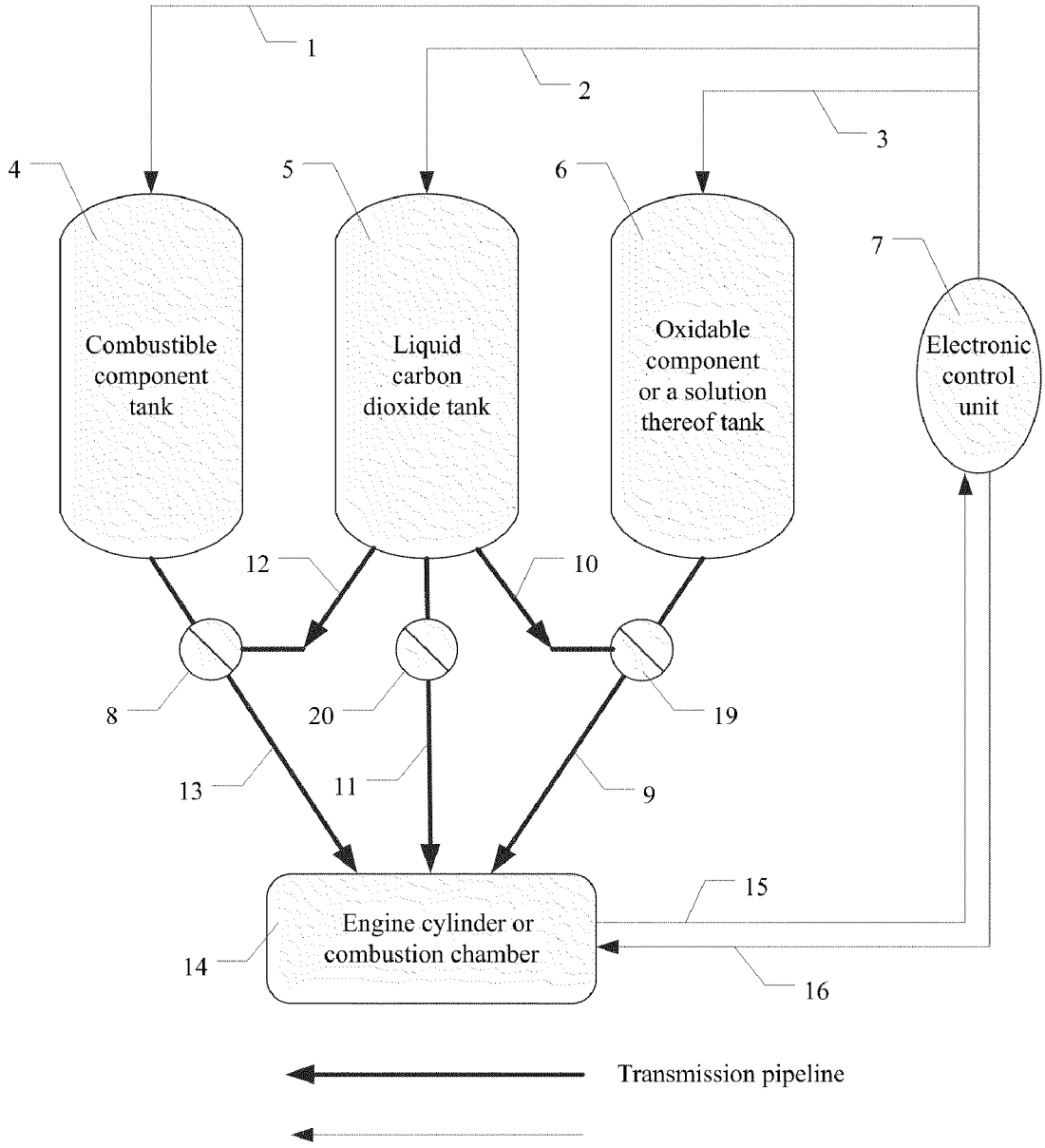
FIG. 3 is a schematic diagram of an apparatus for use in a method of burning fuel according to an exemplary embodiment of the invention.
Figure 4:
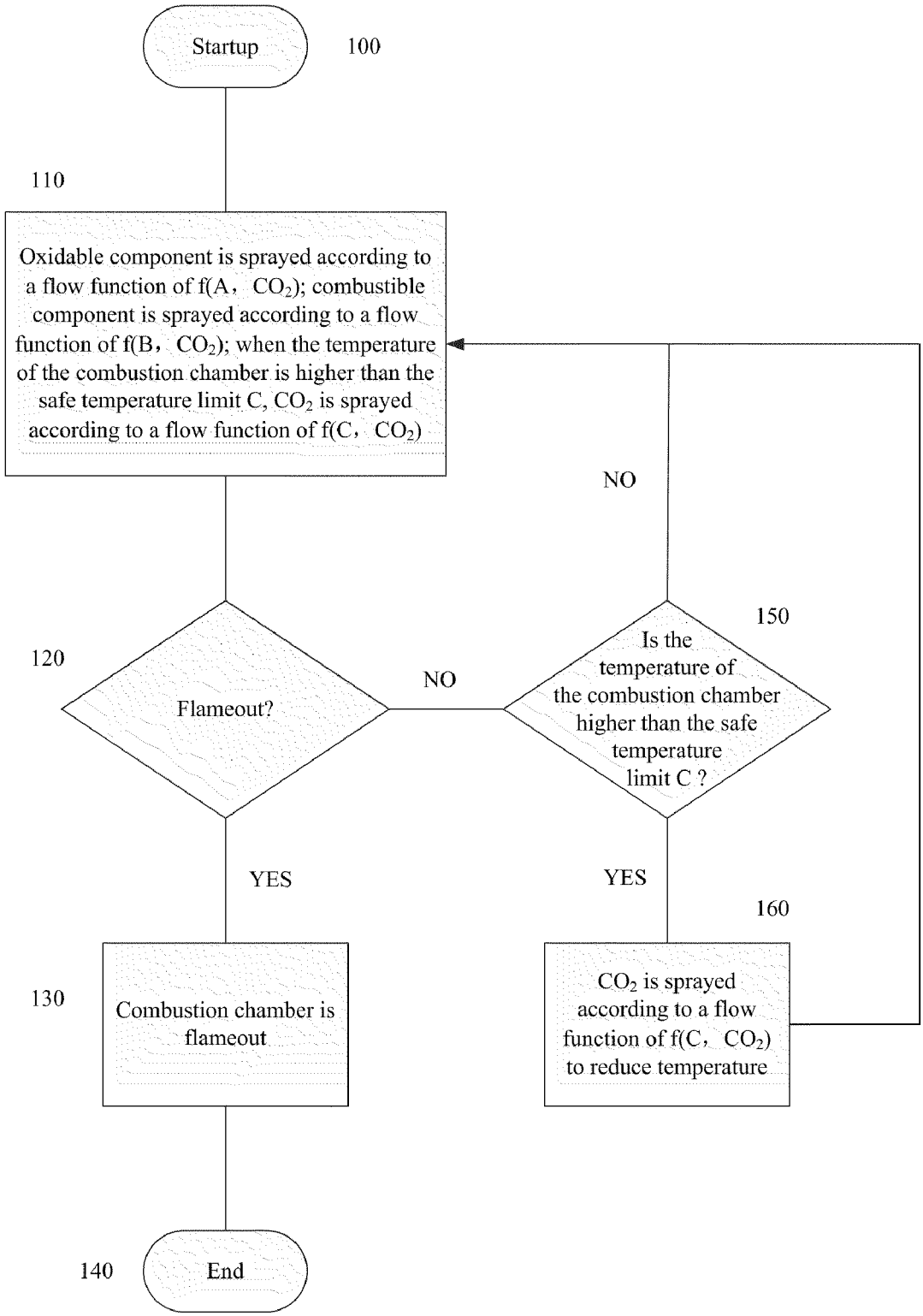
FIG. 4 is a flow chart of a method for burning fuel according to an exemplary embodiment of the invention.

FIGS. 3 and 4 in combination show a method of burning a low carbon content of fuel.

FIG. 3 is a schematic diagram of an exemplary apparatus used for burning a low carbon content of fuel. FIG. 4 is a flow chart of burning a low carbon content of fuel. A usage program is stored in an electronic control unit 7 in FIG. 3.

f (A, $CO_2$) is a flow function between an oxidizing component A and carbon dioxide. Herein the oxidizing component A refers to ammonium nitrate powders, and carbon dioxide is a transmission medium of ammonium nitrate powders. The weight percent of the oxidizing component A is:

$$A\%=[K_b/(K_a+K_b)]\times 100\%.$$

f (B, $CO_2$) is a flow function between a combustible component B and carbon dioxide. Herein, the oxidizing component B refers to urea powders, and carbon dioxide is a transmission medium of urea powders. The weight percent of the oxidizing component B is:

$$B\%=[K_a/(K_a+K_b)]\times 100\%.$$

Herein, $K_a$ is the oxygen balance value of the oxidizing component A, and $K_b$ is the oxygen balance value of the combustible component B.

f (C, $CO_2$) is a flow function between temperature C and carbon dioxide. When the temperature in an engine cylinder or jet combustion chamber 14 (hereinafter refers to combustion chamber 14) is higher than a safety limit temperature C, according to the function of f(C, $CO_2$), the gas flow of carbon dioxide is increased to cool down the combustion chamber.

Taking urea as the combustible component B and ammonium nitrate as the oxidizing component A, as shown in FIGS. 3 and 4, step 100 was initiated, and step 110 followed. An electronic control unit 7 was connected to a combustible component tank 4, a first electromagnetic valve, a first high-pressure pump 8, and a combustion chamber 14 via routes 1 and 13. According to the formula of weight percent of the oxidizing component B: $B\%=[K_a/(K_a+K_b)]\times 100\%$, the weight percent of urea is 20%. According to the flow function f (B, $CO_2$), carbon dioxide flow rate was determined. With the transmission of carbon dioxide, 20% by weight of urea was sprayed into the combustion chamber 14.

The electronic control unit 7 was connected to an oxidizing component tank 6, a second electromagnetic valve, a second high-pressure pump 19, and the combustion chamber 14 via routes 3 and 9. According to the formula of weight percent of the combustible component A: $A\%=[K_b/(K_a+K_b)]\times 100\%$, the weight percent of ammonium nitrate is 80%. According to the flow function f (A, $CO_2$), carbon dioxide flow rate was determined. With the transmission of carbon dioxide, 80% by weight of ammonium nitrate was sprayed into the combustion chamber 14.

Meanwhile, the electronic control unit 7 controlled to ignite a spark plug of the combustion chamber 14 via route 16, and a strong oxidation-reduction reaction occurred between the ammonium nitrate powder and the urea powder and did work.

Step 120 was performed: flameout or not? If not, then step 150 was followed, and it was determined that whether the temperature of the combustion chamber 14 was higher than the safe temperature limit C. If not, step 110 was performed; if yes, step 160 was performed.

As shown in FIG. 3, the electronic control unit 7 was directly connected to the combustion chamber 14 via route 15. The route 15 was designed to obtain the feedback of temperature signals from the combustion chamber 14. When the temperature of the combustion chamber 14 was higher than the safe temperature limit C, the temperature signals were reported to the electronic control unit 7 via the route 15. The electronic control unit 7 was connected to a liquid carbon dioxide tank 5, a third electromagnetic valve, a third high-pressure pump 20, and the combustion chamber 14 via routes 2 and 11. According to the flow function f (C, $CO_2$), the carbon dioxide flow was increased to cool down the combustion chamber 14.

Step 120 was performed: flameout or not? If yes, then a step 130 was followed. Under the control of the electronic control unit 7 via the routes 1, 2, 3 and 16, the transmission of combustible component, the oxidizing component, and carbon dioxide to the combustion chamber 14 was suspended, and the spark plug flamed out. Then, step 140 was followed and the end of operation was reached.

The above steps of initiation, ignition, doing work, cooling, flameout, and end were a cycle process. Just like a conventional engine, functions such as initiation, acceleration, deceleration, idling, flameoff, and cooling of a combustible chamber can be achieved by increasing or decreasing the transmission amount of the oxidizing component A, the combustible component B, or carbon dioxide. Although the transmission amount may be changeable, the weight percent of the oxidizing component A and the combustible component B was constant, so that the operation was performed under the condition of zero oxygen balance.

According to flow functions f(B, $CO_2$), f(A, $CO_2$), and f(C, $CO_2$), the amount of the oxidizing component A, the combustible component B, and as a transmission medium and coolant the flow rate of carbon dioxide were adjusted. Therefore, an oxidation-reduction reaction between the oxidizing component A and the combustible component B can be controlled to occur under a certain temperature and zero oxygen balance in the combustion chamber 14 to yield a strong driving force.

EXAMPLE 9

According to Example 5, as a combustible component B amine methyl nitrate and as an oxidizing component A ammonium nitrate powder were separately prepared, and the weight ratio is given below:

| Components | $CH_3$—$NH_2$•$HNO_3$ | $NH_4NO_3$ |
|---|---|---|
| Oxygen balance value | −0.34 | +0.2 |
| Weight ratio (%) | 37.0370 | 62.9630 |

Before use, amine methyl nitrate was prepared as an aqueous solution, with a concentration of 86% by weight, and stored in a first tank with temperature no more than 95° C. Likewise, ammonium nitrate was prepared as an aqueous solution, with a concentration of 86-93% by weight, and stored in a second tank with temperature no less than 100° C.

The spray and ignition of the two solutions was the same as that for conventional engines. The two solutions were directly sprayed and ignited, and the following steps and reaction conditions were the same as that in Example 8.

EXAMPLE 10

As a combustible component B liquid nitromethane and as an oxidizing component A potassium nitrate powder were separately prepared, and the weight ratio is given below:

| Components | $CH_3NO_3$ | $KNO_3$ |
|---|---|---|
| Oxygen balance value | −0.395 | +0.396 |
| Weight ratio (%) | 50.0632 | 49.9368 |

Carbon dioxide was the transmission medium of potassium nitrate powder, and the steps and conditions were the same as that in Example 1.

The transmission of liquid nitromethane was synchronized with that of potassium nitrate powder. The two components were directly sprayed and ignited, and the following steps and conditions were the same as that in Example 9. Particularly, in this example, the resultant potassium oxide is an alkaline metal oxide, which can decrease the acidity of sea water and protect marine organisms, e.g., clams and corals.

EXAMPLE 11

According to Example 6, as a combustible component B aluminum powder and as an oxidizing component A ammonium nitrate powder were separately prepared, the weight ratio being:

| Components | Al | $NH_4NO_3$ |
|---|---|---|
| Oxygen balance value | −0.89 | +0.2 |
| Weight ratio (%) | 18.349 | 81.651 |

In the example, the steps and conditions were the same as that in Example 1. The components have no carbon element, so the prepared fuel has no carbon emissions, i.e., zero carbon emissions. The resultant aluminum oxide is alkaline under acidic conditions, which can neutralize the acidity of sea water and save marine organisms, e.g. clams and corals.

EXAMPLE 12

As a combustible component B hydrogen and as an oxidizing component A ammonium nitrate powder were separately prepared, the weight ratio being:

| Components | $H_2$ | $NH_4NO_3$ |
|---|---|---|
| Oxygen balance value | −8.0 | +0.20 |
| Weight ratio (%) | 2.439 | 97.561 |

The transmission of ammonium nitrate powder was the same as that in Example 8. The transmission of hydrogen was the same as that of carbon dioxide. Hydrogen and ammonium nitrate powder were sprayed and ignited synchronously. The following steps and conditions were the same as that in Example 8.

Industrial Applicability

In the invention, low carbon content of fuels are cost-effective, environmentally friendly, self-supplying oxygen, and have a high volume energy density, a wide source, and a diversity. Particularly, low carbon emissions and zero carbon emissions can be achieved by using of low carbon content fuels of the invention. Low carbon content fuels are suitable for the corresponding application of conventional fuels.

Furthermore, it should be noted that engines of rockets, boosters, military carrier aircraft, and missiles are driven by a reaction between oxidizing components and combustible components, which is disclosed by prior art. Therefore, development of engines for burning low carbon content of fuels of the invention is within the field of prior art.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A method of burning fuel in a combustion chamber whereby reducing carbon emissions, comprising:

feeding an oxidizing component and a combustible component to a combustion chamber in a ratio based on zero oxygen balance principle, wherein said oxidizing component has an oxygen balance value of more than zero, and is selected from hydrogen peroxide, ammonium nitrate aqueous solution, ammonium nitrate powder, potassium nitrate, sodium nitrate, calcium nitrate, hydrazine nitrate, ammonium perchlorate, sodium perchlorate, potassium perchlorate, potassium chlorate, potassium dichromate, or sodium nitrite, and said combustible component has an oxygen balance value of less than zero, and is selected from liquid polyacrylamide, dinitrate, nitromethane, powdery amine methyl nitrate, calcium stearate, polyacrylamide, dextrin, starch, sugar, dodecylbenzene sodium nitrate, trimethylamine nitrate, cellulose, urea, urea nitrate, trinitronaphthalene, sodium dinitrotoluene sulfonate, dinitrotoluene, amine methyl nitrate aqueous solution, aluminum powder, zinc powder, silica powder, or hydrogen.

2. A method of burning fuel in a combustion chamber whereby reducing carbon emissions, comprising:

feeding an oxidizing component and a combustible component to a combustion chamber in a ratio based on zero oxygen balance principle, wherein said oxidizing component has an oxygen balance value of more than zero, said combustible component has an oxygen balance value of less than zero; and said oxidizing component is hydrogen peroxide, ammonium nitrate aqueous solution, ammonium nitrate powder, potassium nitrate, sodium nitrate, calcium nitrate, hydrazine nitrate, ammonium perchlorate, sodium perchlorate, potassium perchlorate, potassium chlorate, potassium dichromate, or sodium nitrite.

3. The method of claim 1, wherein said ammonium nitrate is provided as an aqueous solution having a concentration of 84-91% by weight at 80-100° C.

4. The method of claim 2, wherein said combustible component is liquid polyacrylamide, glycol, diethylene glycol dinitrate, nitromethane, gasoline, light diesel oil, mineral oil, or powdery amine methyl nitrate, calcium stearate, polyacrylamide, dextrin, starch, charcoal, sugar, dodecylbenzene sodium nitrate, trimethylamine nitrate, cellulose, wood powder, urea, urea nitrate, trinitronaphthalene, sodium dinitrotoluene sulfonate, dinitrotoluene, amine methyl nitrate aqueous solution, aluminum powder, zinc powder, silica powder, or hydrogen.

5. The method of claim 1, wherein said amine methyl nitrate is provided as an aqueous solution at a concentration of 80-90% by weight at 80-100° C.

6. The method of claim 1, wherein said oxidizing component is a powder having a mesh number of between 30 and 10,000.

7. The method of claim 1, wherein said combustible component is a powder having a mesh number of between 30 and 10,000.

8. The method of claim 1, wherein said combustible component is $CH_3—NH_2·HNO_3$(amine methyl nitrate), said oxidizing component is $H_2O_2$(hydrogen peroxide), said combustible component is provided in a weight ratio of about 58.0247% with respect to the total weight of said combustible component and said oxidizing component, and said oxidizing component is provided in a weight ratio of about 41.9753% with respect to the total weight of said combustible component and said oxidizing component, and wherein said combustible component is provided in powder form and said oxidizing component is provided in liquid form.

9. The method of claim 1, wherein said combustible component is $CO(NH_2)_2$(urea), said oxidizing component is $NH_4NO_3$(ammonium nitrate), said combustible component is provided in a weight ratio of about 20% with respect to the total weight of said combustible component and said oxidizing component, and said oxidizing component is provided in a weight ratio of about 80% with respect to the total weight of said combustible component and said oxidizing component, and wherein said combustible component is provided in powder form and said oxidizing component is provided in powder form.

10. The method of claim 1, wherein said combustible component is $CH_3NO_2$ (nitromethane), said oxidizing component is $NH_4NO_3$(ammonium nitrate), said combustible component is provided in a weight ratio of about 33.613% with respect to the total weight of said combustible component and said oxidizing component, and said oxidizing component is provided in a weight ratio of about 66.387% with respect to the total weight of said combustible component and said oxidizing component, and wherein said combustible component is provided in liquid form and said oxidizing component is provided in powder form.

11. The method of claim 2, wherein said combustible component is $C_{16}H_{32}$(hexadecene), said oxidizing component is $NH_4NO_3$(ammonium nitrate), said combustible component is provided in a weight ratio of about 5.5249% with respect to the total weight of said combustible component and said oxidizing component, and said oxidizing component is provided in a weight ratio of about 94.4751% with respect to the total weight of said combustible component and said oxidizing component, and wherein said combustible component is provided in liquid form and said oxidizing component is provided in powder form.

12. The method of claim 1, wherein said combustible component is $CH_3—NH_2·HNO_3$, said oxidizing component is $NH_4NO_3$, said combustible component is provided in a weight ratio of about 37.0370% with respect to the total weight of said combustible component and said oxidizing component, and said oxidizing component is provided in a weight ratio of about 62.9630% with respect to the total weight of said combustible component and said oxidizing component, and wherein said combustible component is provided in liquid form and said oxidizing component is provided in liquid form.

13. The method of claim 1, wherein said combustible component is Al (aluminum), said oxidizing component is $NH_4NO_3$, said combustible component is provided in a weight ratio of about 18.349% with respect to the total weight of said combustible component and said oxidizing component, and said oxidizing component is provided in a weight ratio of about 81.651% with respect to the total weight of said combustible component and said oxidizing component, and wherein said combustible component is provided in powder form and said oxidizing component is provided in powder form.

14. The method of claim 1, wherein said combustible component is $H_2$(hydrogen), said oxidizing component is $NH_4NO_3$(ammonium nitrate), said combustible component is provided in a weight ratio of about 2.439% with respect to the total weight of said combustible component and said oxidizing component, and said oxidizing component is provided in a weight ratio of about 97.561% with respect to the total weight of said combustible component and said oxidizing component, and wherein said combustible component is provided in gaseous form and said oxidizing component is provided in powder form.

15. The method of claim 1, wherein said combustible component is $CH_3$—$NH_2 \cdot HNO_3$(amine methyl nitrate), said oxidizing component is $NH_4NO_3$(ammonium nitrate), said combustible component is provided in a weight ratio of about 37.0370% with respect to the total weight of said combustible component and said oxidizing component, and said oxidizing component is provided in a weight ratio of about 62.9630% with respect to the total weight of said combustible component and said oxidizing component.

16. The method of claim 1, wherein said combustible component is $CH_3NO_3$(nitromethene), said oxidizing component is $KNO_3$, (potassium nitrate), said combustible component is provided in a weight ratio of about 50.0632% with respect to the total weight of said combustible component and said oxidizing component, and said oxidizing component is provided in a weight ratio of about 49.9368% with respect to the total weight of said combustible component and said oxidizing component.

17. A method of claim 1, wherein said oxidizing component is selected from hydrogen peroxide, ammonium nitrate aqueous solution, ammonium nitrate powder, hydrazine nitrate, ammonium perchlorate, sodium perchlorate, potassium perchlorate, potassium chlorate, potassium dichromate, or sodium nitrite.

* * * * *